US007889873B2

(12) United States Patent
Sorensen

(10) Patent No.: US 7,889,873 B2
(45) Date of Patent: Feb. 15, 2011

(54) MICROPHONE APERTURE

(75) Inventor: Ole Moller Sorensen, Roskilde (DK)

(73) Assignee: DPA Microphones A/S, Allerod (DK)

( * ) Notice: Subject to any disclaimer, the term of this patent is extended or adjusted under 35 U.S.C. 154(b) by 1041 days.

(21) Appl. No.: 10/587,657

(22) PCT Filed: Jan. 27, 2005

(86) PCT No.: PCT/DK2005/000056

§ 371 (c)(1),
(2), (4) Date: Jul. 28, 2006

(87) PCT Pub. No.: WO2005/074317

PCT Pub. Date: Aug. 11, 2005

(65) Prior Publication Data

US 2009/0226004 A1 Sep. 10, 2009

(30) Foreign Application Priority Data

Jan. 29, 2004 (DK) ..... 2004 00124

(51) Int. Cl.
*H04R 3/00* (2006.01)

(52) U.S. Cl. ..... 381/92

(58) Field of Classification Search ..... 381/92, 381/122, 94.3

See application file for complete search history.

(56) References Cited

U.S. PATENT DOCUMENTS 4,696,043 A 9/1987 Iwahara et al.
5,058,170 A 10/1991 Kanamore et al.

(Continued)

FOREIGN PATENT DOCUMENTS

FR 2831763 A1 5/2003

(Continued)

OTHER PUBLICATIONS

Thomas Chou, "Frequency-Independent Beamformer with Low Response Error" May 1995, pp. 2295-2298, IEEE.

(Continued)

*Primary Examiner*—Curtis Kuntz
*Assistant Examiner*—Hai Phan
(74) *Attorney, Agent, or Firm*—Birch, Stewart, Kolasch & Birch, LLP

(57) ABSTRACT

Microphone array for achieving a substantially frequency-independent directivity using a plurality of microphones disposed along a rectilinear array. The rectilinear array is at least as long as the wavelength of the lowest frequency, where a useful directivity is desired. The rectilinear array has a first end and a second end. The microphones close to the first end are intended for the highest frequencies and the microphones close to the second end are intended for the lowest frequencies. The mutual spacing of the microphones is frequency-dependent. The signals from the individual microphones are band-pass filtered, the passbands and cut-off frequencies of the individual band-pass filters being adapted to the frequency band the individual microphones are intended for. The individual band-pass filters are adapted such that the amplitude of the summated signal after band-pass filtering is substantially the same when a sinus-shaped test signal is used, the amplitude of said test signal being constant and the frequency of said test signal varying within the frequency range where the microphone array is to have a substantially frequency-independent directivity.

9 Claims, 11 Drawing Sheets

U.S. PATENT DOCUMENTS

| | | | | |
|---|---|---|---|---|
| 5,473,701 | A | 12/1995 | Cezanne et al. | |
| 5,657,393 | A | 8/1997 | Crow | |
| 6,317,501 | B1 | 11/2001 | Matsuo | |
| 6,526,147 | B1 | 2/2003 | Rung | |
| 6,898,582 | B2 * | 5/2005 | Lange | 706/14 |
| 2002/0069054 | A1 | 6/2002 | Arrowood et al. | |

FOREIGN PATENT DOCUMENTS

| | | | |
|---|---|---|---|
| WO | WO-01/58209 | A1 | 8/2001 |
| WO | WO-01/71687 | A2 | 9/2001 |

OTHER PUBLICATIONS

Menno Van Der Wal et al., "Design of Logarithmically Spaced Constant—Directivity Transducer Arrays", Jun. 1996, pp. 497-507,vol. 44 No. 6,J. Audio Eng. Soc.

Joseph Lardies, "Acoustic Ring Array with Constant Beamwidth Over a Very Wide Frequency Range", 1989, pp. 77-81, vol. 13, No. 5, Acoustics Letters.

* cited by examiner

MICROPHONE APERTURE

TECHNICAL FIELD

The invention relates to a microphone array for achieving a substantially frequency-independent directivity using a plurality of microphones disposed along a rectilinear array.

BACKGROUND ART

A microphone array of this type can for example be used for recordings, where a frequency-independent directivity is desirable. Microphones are inter alia characterised by their sensitivity to different frequencies, but also by their sensitivity to the angle of incidence of the sound waves into the microphone. A microphone may, for example, have a spherical characteristic, where it receives sound waves substantially equally well from all angles, however, a microphone may also have a more or less conical directional characteristic. Thus, the microphone is highly sensitive to sound waves coming from a particular direction and less sensitive to sound waves coming from other directions. When microphones are used for the recording or transmission of, for example, music in a recording studio or a concert hall, the selection of the types of microphones used depends on a number of circumstances, such as, for example, the instrumentation in question, the acoustic environment in the recording room and the desired acoustic pattern. In order to be able to create an optimum recording under a multitude of different conditions, it is required that a large number of different types of microphones is available. Usually, many microphones are used for a task at hand, said microphones being moved around and exchanged with respect to the requirements that may arise. For example, a microphone may be required, where the directivity of said microphone may be improved with respect to existing types, while altering the frequency dependence of the directivity, the basis thereof being a microphone with constant frequency and an improved directivity in a larger frequency range. Thus, the same microphone may be adapted electronically to different needs. The number of different types as well as switching between said types may thus be achieved in a considerably easier and more flexible way.

Further advantages become apparent, if the same microphone could be made to focus on several adjustable directions simultaneously, thus possessing individually adjustable directivity characteristics for each of these directions. Depending on the actual acoustic conditions, such a microphone may replace a varying number of conventional type microphones, at the same time achieving improved results and less time consumption in the recording room.

Thus, there is a need for a microphone with controllable, substantially frequency-independent directivity, i.e. the directivity within a considerable frequency range is substantially the same, or said microphone possessing a preselected characteristic, said characteristic being improved with respect to conventional microphones. It is advantageous that the system is designed in such a way that it is able to focus on several points in space simultaneously.

Systems fulfilling these needs to a varying degree are well-known in the art. U.S. Pat. No. 5,657,393 discloses an elongated microphone array with a plurality of microphones disposed in groups depending on their frequencies, said groups either being disposed adjacent each other or along an elongated array. The system makes use of band-pass filters for each group of microphones, and the resulting signals behind the band-pass filter are summated, and the resulting signal is a signal with high directivity. The system shows a good directivity characteristic in the direction of the elongated array, however, a system of this type is disadvantageous in several ways. The two major disadvantages are instabilities arising at the transition from one group to the next and thus instabilities arising in the frequency-dependent directivity characteristic because of the grouping of microphones according to frequencies. Since the elongated array has a physical extension so that the sound signals reach the individual microphones at different times, a time correlation is used to establish the desired directivity characteristic. A microphone array of this type is often referred to as an "end-fire" microphone.

Joseph Lardies: "Acoustic ring array with constant beamwidth over a very wide frequency range", Acoustic letters, Vol. 13, no. 5, p. 77-81 discloses a technique for maintaining the beamwidth of a transducer constant over a frequency range of N octaves. An acoustical ring array of six sensors is used to produce a radiation pattern at a given frequency, whereas a half-scale model is implemented to give the same directivity pattern at the double frequency. Compensation filters are used in the respective array outputs to produce a constant beamwidth over the corresponding octave. The design process can be repeated N times in order to obtain an acoustical array with constant beam width over a frequency range of N octaves. However, the beam width is only constant in the plane of the acoustical array. Furthermore, the technique uses eighth-order Butterworth band-pass filters, which have very sharp cut-off frequencies and a flat response in the passband. As a result, the transducer has very distinct sidelopes, which means the directivity of the transducer is very poor. The article does not mention or suggest any means to change the directivity of the transducer.

WO 0158209 discloses a system having a number of microphones disposed in a circle for recording a sound field: The document provides a thorough analysis of the frequency characteristic for such a system and it is shown, how the amplification in the system depends on the number of microphones, and which frequencies are observed. The disclosed examples show a strong frequency dependence with respect to amplitude information, and the system for processing the signals is relatively complicated.

WO 0171687 discloses a surveillance system, where a network of microphones is used to monitor conversations in a large room. A special device is equipped with a large number of microphones in order to obtain high directivity, but this only succeeds at the cost of the frequency information.

U.S. Pat. No. 6,317,501 discloses a system having a network of microphones, said network being used to obtain directional information from incident sound. The system uses filters and time delays to generate an output signal. The system is specifically designed to find directional information in a sound field.

U.S. Pat. No. 6,526,147 describes an elongated microphone array with pairs of microphones disposed on each side of the microphone array. The microphones are arranged equidistantly. The signal from each pair of microphones is summated and transmitted to a filter, and the resulting filtered signals are summated. However, the results shown display a certain frequency-dependent directivity.

U.S. Pat. No. 4,696,043 shows a microphone array with microphones disposed equidistantly, a network with weighting factors being used to alter the directivity characteristic of the system. It is shown that a great number of different directivity characteristics are obtained, however, said characteristics are highly frequency-dependent.

U.S. Pat. No. 5,058,170 discloses a directional microphone array provided to suppress acoustic feedback and howling generated by loudspeaker systems.

U.S. Pat. No. 5,473,701 discloses a system for use with mobile telephones, where two microphones are used to obtain high directivity. This is achieved by means of inter alia delay circuits and low-pass filters.

US Patent Application No. 20020069054 discloses a system having a number of microphones, said microphones apparently rotating in space by means of time delays. The document also states that the system can focus on several points simultaneously.

DISCLOSURE OF INVENTION

Therefore, there is a need for a microphone or a microphone array possessing a directivity, which has controllable characteristics and is substantially frequency-independent, and where the degree of frequency dependence is selected. This is achieved by means of a microphone array according to the characterising portion of claim 1.

When the individual microphones of the microphone array are disposed depending on their frequency, and the band-pass filters are adjusted to the individual microphones with respect to their location in the array, frequency characteristic of the directivity is improved considerably, especially for low frequencies, but also for high frequencies.

Finally, the individual signals from the individual microphones may each be recorded separately, and the desired directivity may be determined at a later stage by means of band-pass filtering and summation.

The invention also relates to a microphone arrangement comprising at least two of the above-mentioned microphone arrays, where the at least two microphone arrays are arranged in one plane.

In this connection, it is, for example, conceivable to dispose two of the above-mentioned microphone arrays along one axis, whereby some particularly beneficial properties are obtained with respect to the directivity of the microphone arrangement.

In another embodiment of the invention the microphone arrays are disposed along radii extending from the centre of an imagined circle, the first ends of the microphone arrays facing the centre. The microphone arrays are preferably disposed in such a way that at least two different individual microphones from different microphone arrays are disposed along imagined concentric circles having the same centre.

Thus, an even better directivity is obtained.

In a preferred embodiment of the invention, the shortest circular arc spacing between microphones on the circle closest to the centre substantially corresponds to or is smaller than the radial distance between the two circles closest to the centre. In a particularly preferred embodiment of the invention, the signals from the individual microphones are each independently associated with time delays selected in such a way that the effect of the microphone arrangement is focused in at least one direction and/or against one punctiform area in front of the microphone apparatus.

Thus, several directivities and/or focusing areas may be obtained simultaneously by selecting the correct time delays, said directivities and/or focusing areas having the same efficiency.

In a further embodiment of the invention, the individual band-pass filterings for summated signals from the individual microphones on the same circular arc are carried out after the signals from the microphones have been time-delayed.

In a particularly preferred embodiment the signals from the individual microphones are run through several sets of time delays and/or several sets of band-pass filters.

Thus, even more directivities may be obtained without negative impact on the efficiency.

BRIEF DESCRIPTION OF THE DRAWING

The invention is explained below by way of embodiments and with reference to the drawings, in which.

BEST MODE(S) FOR CARRYYING OUT THE INVENTION

The invention is explained below by way of an example, but it will be understood that the invention is not limited to this example.

Figure 1:
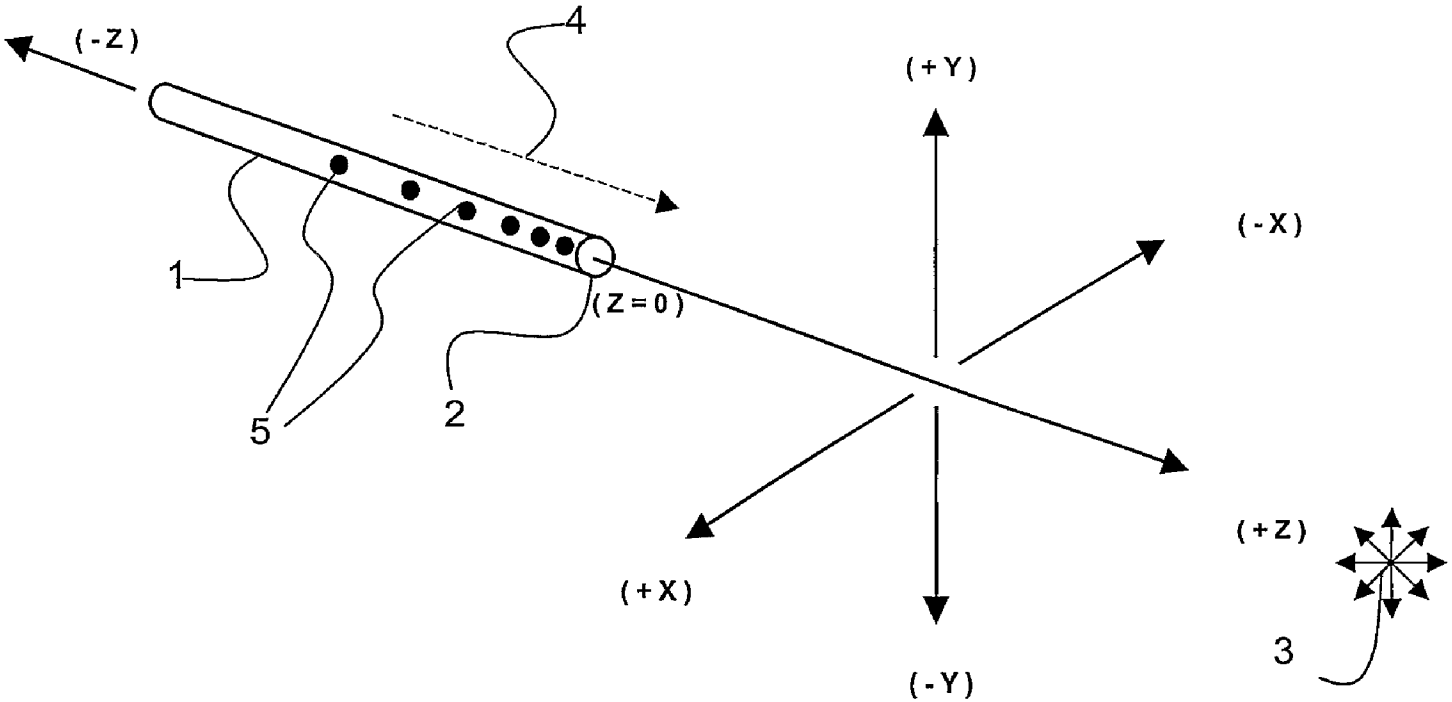
FIG. 1 shows a microphone array with microphones disposed along a rectilinear array, also known as "end fire"
Figure 2:
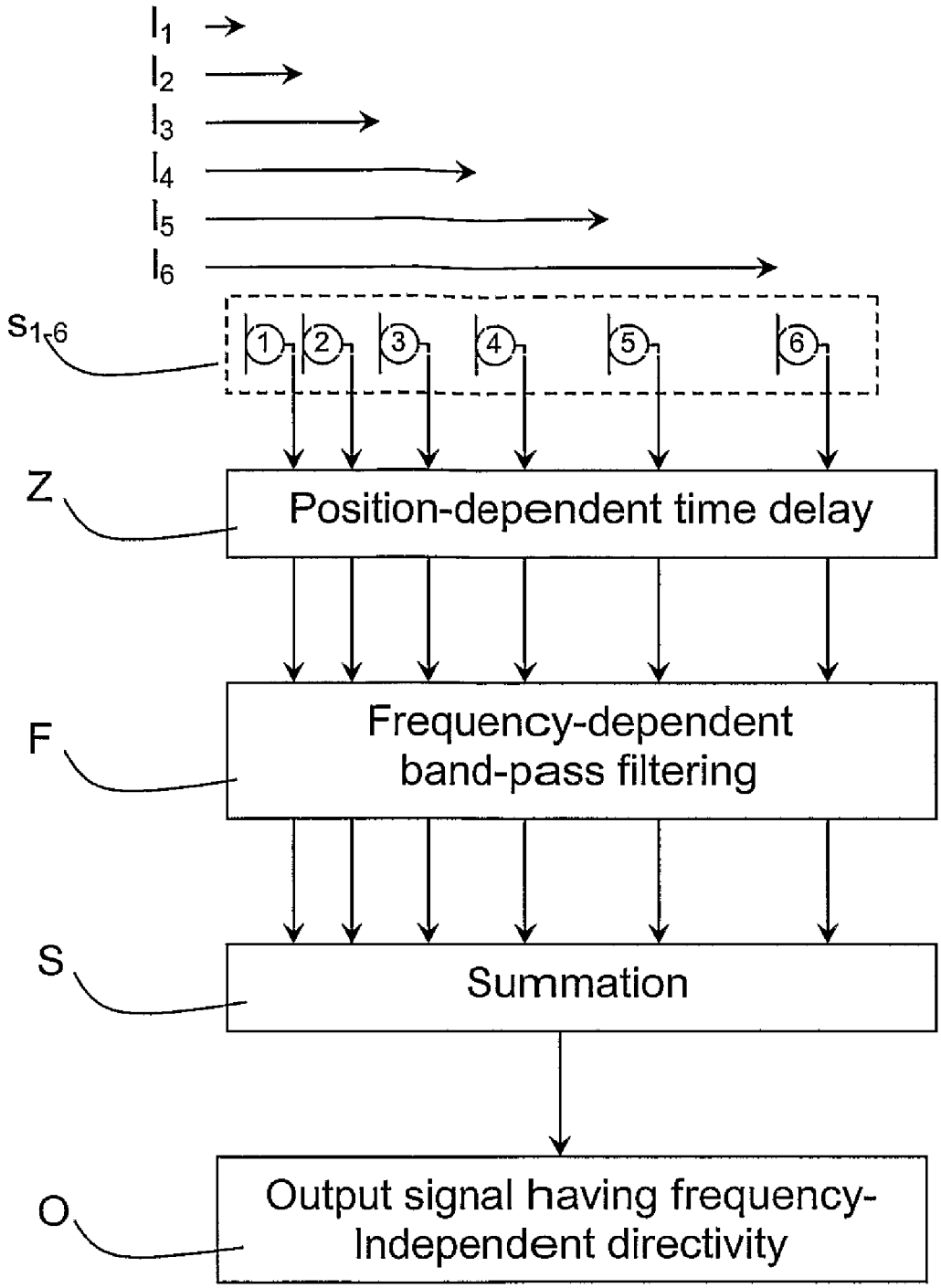
FIG. 2 shows a microphone array according to the invention with position-dependent time delay and position-dependent band-pass filtering.

FIG. 1 shows a microphone array 1 having a reference end 2 and a sound source 3 as well as a direction towards the sound source 4. An array of this type is often referred to as an "end-fire" microphone. The microphone array shown is a rectilinear element with individual microphones 5 disposed along the longitudinal axis, said microphone being disposed with the smallest spacing in the direction towards the sound source and a wider spacing away from the sound source. Basically, the length of the microphone array is at least as long as the wavelength of the lowest frequency, for which a high directivity is desired. The lowest frequency must be selected with care, as very low frequencies result in long microphone arrays of up to several meters in length. Moreover, at very low frequencies it is also doubtful, how much is achieved by a high directivity, since the human ear does not well pick up directional information on deep sounds.

The positioning of the individual microphones in the microphone array is frequency-dependent, the position of said individual microphones being found using the following expression:

$$l_n = l \cdot 2^{-\left(\frac{N-n}{d}\right)}$$

wherein 1 is the length of, for example, the longest wavelength, for which frequency independence is desired, 1.sub.n is the position of the n'th microphone, N is the maximum number of microphones and d is the number of microphones per octave. Thus, the ratio between N and d determines the number of octaves to be covered by the microphone array or, in other words, the frequency range of the microphone array. However, the above-mentioned formula for the positions of the individual microphones is not the only way to describe the positioning of said microphones. Overall, the important factor is that the centre-to-centre distances between the individual microphones are the same, when frequency is taken into consideration. Below there is an example of two frequencies $f_1$ and $f_2$, where the frequency for $f_2$ is twice as high as for $f_1$ and where five microphones are considered:

$$f_2 = 2 \cdot f_1$$

$$f_1\colon m_1 = \frac{\sum_{n_1}^{n_1+5-1} l_{n+1} - l_n}{5-1}$$

$$f_2\colon m_2 = \frac{\sum_{m_1}^{m_1+5-1} l_{m+1} - l_m}{5-1}$$

$$m_1 \cong 2 \cdot m_2,$$

wherein $m_1$ is a first mutual spacing between two microphones provided for a first frequency $f_1$, and $m_2$ is a second mutual spacing between two microphones provided for a second frequency $f_2$.

When the microphones are arranged in this manner, their positions become frequency-dependent.

Since the individual microphones are disposed along the microphone array, the sound from the sound source 3 reaches the individual microphones at different times. The individual time delays of the signals from said individual microphones are used to establish directivity. The time delays are calculated based on the propagation velocities and the differential distances between the microphones based on the direction, where the maximum sensitivity of the array is desired to be. If the sound source is placed along the axis 4 of the microphone array, the sound arrives at the individual microphones with a time difference, but since the signals are time-delayed, they appear to reach the individual microphones at the same time. Thus, a high directivity of the signal is obtained, since the signals from the individual microphones upon summation amplify each other, while the sound waves coming from other sound sources not placed along the axis 4 of the microphone array 1 reach the individual microphones at other times and will thus be strongly attenuated. Relatively speaking, however, depending on the direction, some particular angles of incidence continue to amplify signals more than other angles of incidence. This phenomenon is known as grating loops or sidebands, and is well-known to a person skilled in the art, therefore it will not be explained further.

The basic idea of the microphone array according to the invention is to achieve a substantially frequency-independent directivity. In practice, completely frequency-independent directivity is, of course, impossible, however, it is possible to provide said directivity with a high degree of frequency independence. This is only achievable, when certain particular conditions are met, viz. that the individual microphones are disposed in a frequency-dependent pattern along the microphone array, as described above. Subsequently, the individual signals from the individual microphones are time-delayed depending on their position, resulting in a summated signal, where sound waves incident with the axis 4 of the microphone array 1 are summated constructively, whereas sound waves incident at an angle to the microphone array are summated destructively to a greater or lesser degree. After the position-dependent time delay Z, the signals are run through band-pass filters F, the passbands and cut-off frequencies of said filters being dependent on the frequency band for which the individual microphones are intended. After band-pass filtering, the individual signals are summated S, and the resulting output signal O has substantially frequency-independent directivity, if both the frequency-dependent positioning of the microphones, the position-dependent time delay and band-pass filtering have been chosen correctly. It should be noted that the directivity of the microphone array may be altered, depending on what is desired, from having a very high directivity to having a very low directivity, if the pass bands of band-pass filters F are altered. This is carried out solely by altering the band-pass filters, i.e. without making any physical alterations to the microphone array. If necessary, the same signals may be run through several different band-pass filters and the same microphone array may therefore possess several different directivity characteristics at the same time. This is especially important in connection with a two-dimensional or three-dimensional array, as described below.

Figure 3:
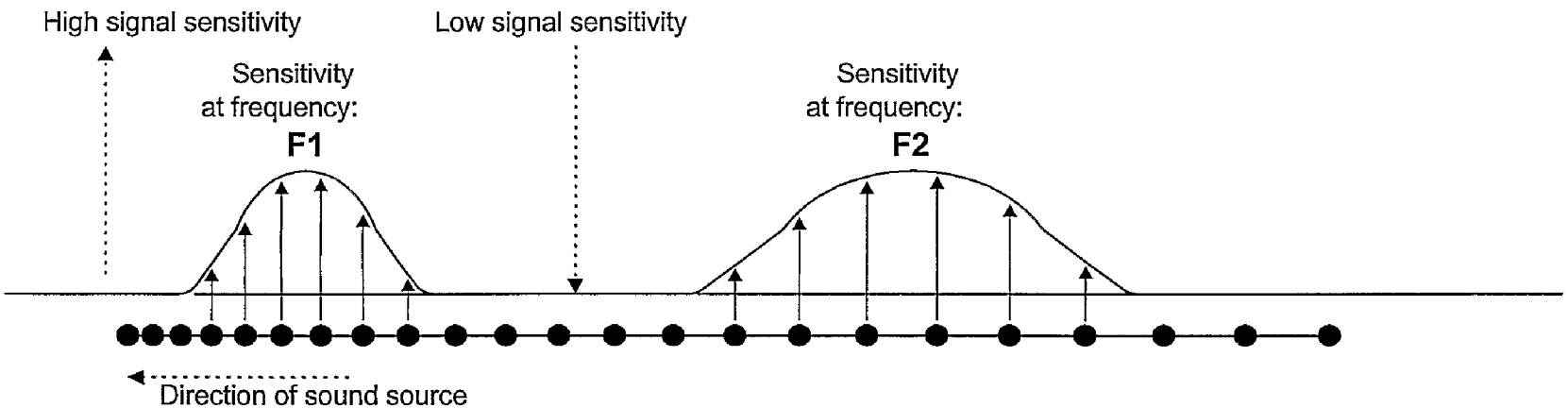
FIG. 3 shows the sensitivity of the microphone array with respect to two frequencies spaced mutually far apart.

FIG. 3 shows a microphone array according to the invention, where the band-pass filters of the individual microphones are disposed according to frequency, depending on the frequency band the individual microphones are intended for. This means that the microphones to the left closest to the sound source and being disposed with the smallest spacing is provided for the highest frequencies, wherefore the passband of the band-pass filter is set for a high frequency. The microphones further away from the sound source are intended for lower frequencies, wherefore the passbands of the band-pass filters are set for lower frequencies. Upon applying a signal with two discrete frequencies F1 and F2 being spaced far apart in the frequency band, the following occurs. All microphones receive both frequencies, but the sensitivities of the individual microphones with respect to the individual frequencies F1, F2 are different because of band-pass filtering. Thus, the sensitivity to the high frequency F1 is highest at the microphones close to the sound source, since the band-pass filters are set for high frequencies, whereas the sensitivity to the low frequency F2 is highest at the microphones away from the sound source. Therefore, the sensitivities shown are not the sensitivities of the microphone array, but the sensitivity of the individual microphones to the two frequencies depending on the positions of the microphones. This sensitivity describes the term aperture of a microphone array. Thus, an aperture ("opening") provides selectivity for the individual microphones with respect to the individual frequency bands, thus making it possible to control the interdependence of frequency band and microphone position to a great extent, which is an important aspect in this connection.

Figure 4:
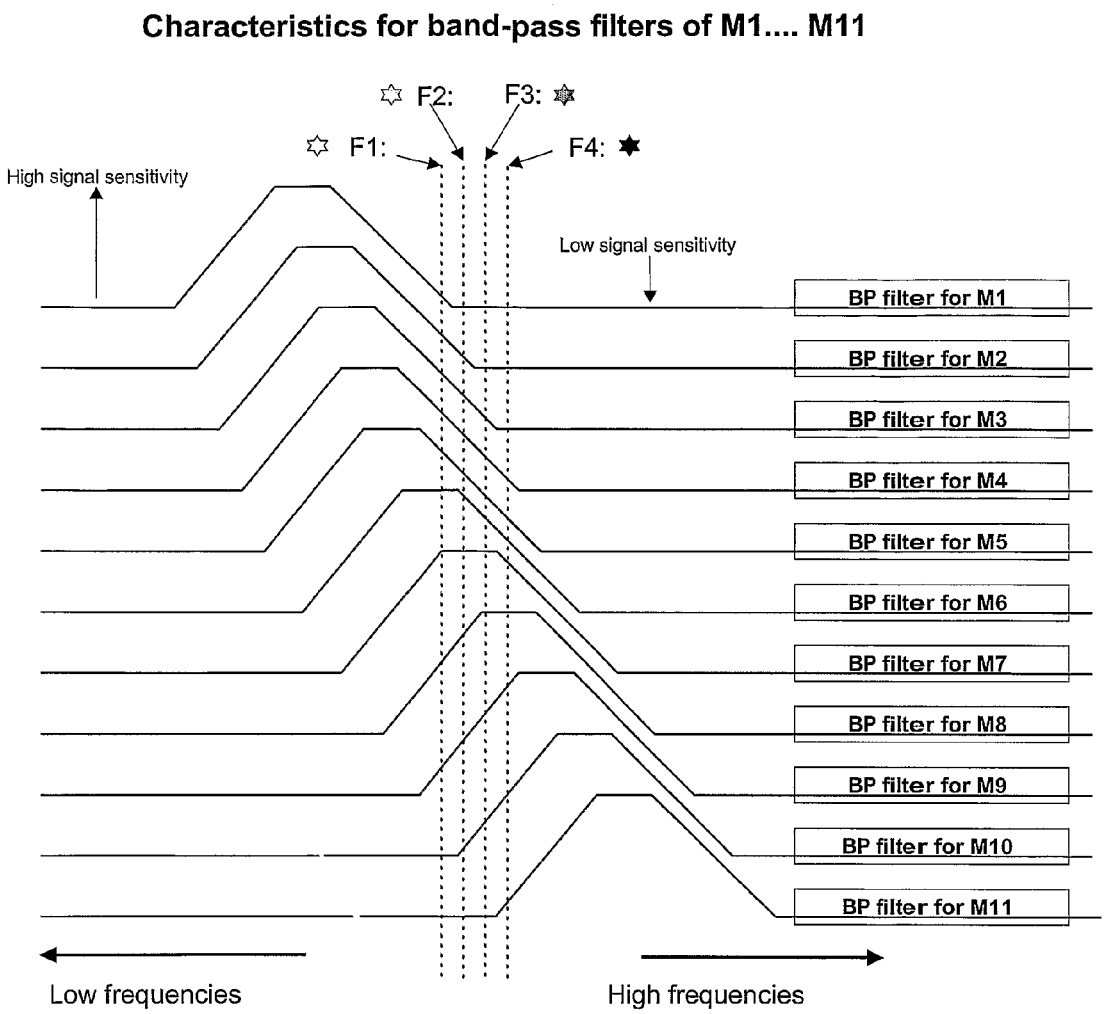
FIG. 4 shows the structure of band-pass filters for corresponding individual microphones in the figures.

FIG. 4 is a schematic representation of the passbands and cut-off frequencies of the band-pass filters for a microphone array having 11 microphones M1-M11. The illustrated microphone array may either be conceived as a greatly simplified embodiment or a section of a larger array. As illustrated, the band-pass filter associated with the microphone for the highest frequencies, i.e. microphone M1, is positioned at a high frequency and cuts off the lowest frequencies, whereas the microphone intended for the lowest frequencies, i.e. microphone M11, has a band-pass filter cutting off the upper frequencies. In FIG. 4, the band-pass filters of the individual microphones are highly representational, the most important information being that the passbands and cut-off frequencies are different for the individual microphones. In order to achieve frequency-independent directivity, the centre frequency of the band-pass filters must have the same exponential curve as the mutual spacing between the microphones. At the same time, the ratio in percent between the bandwidth of the band-pass filters and the centre frequency must be constant. This is also referred to as constant relative bandwidth. If it is desired to change the directivity while maintaining its frequency independence, all band-pass filters must be altered simultaneously and with the same percentage. However, if it is desired to vary the frequency response of the directivity, this is achieved by altering either the centre frequency or the bandwidth of the filters.

Figure 5:
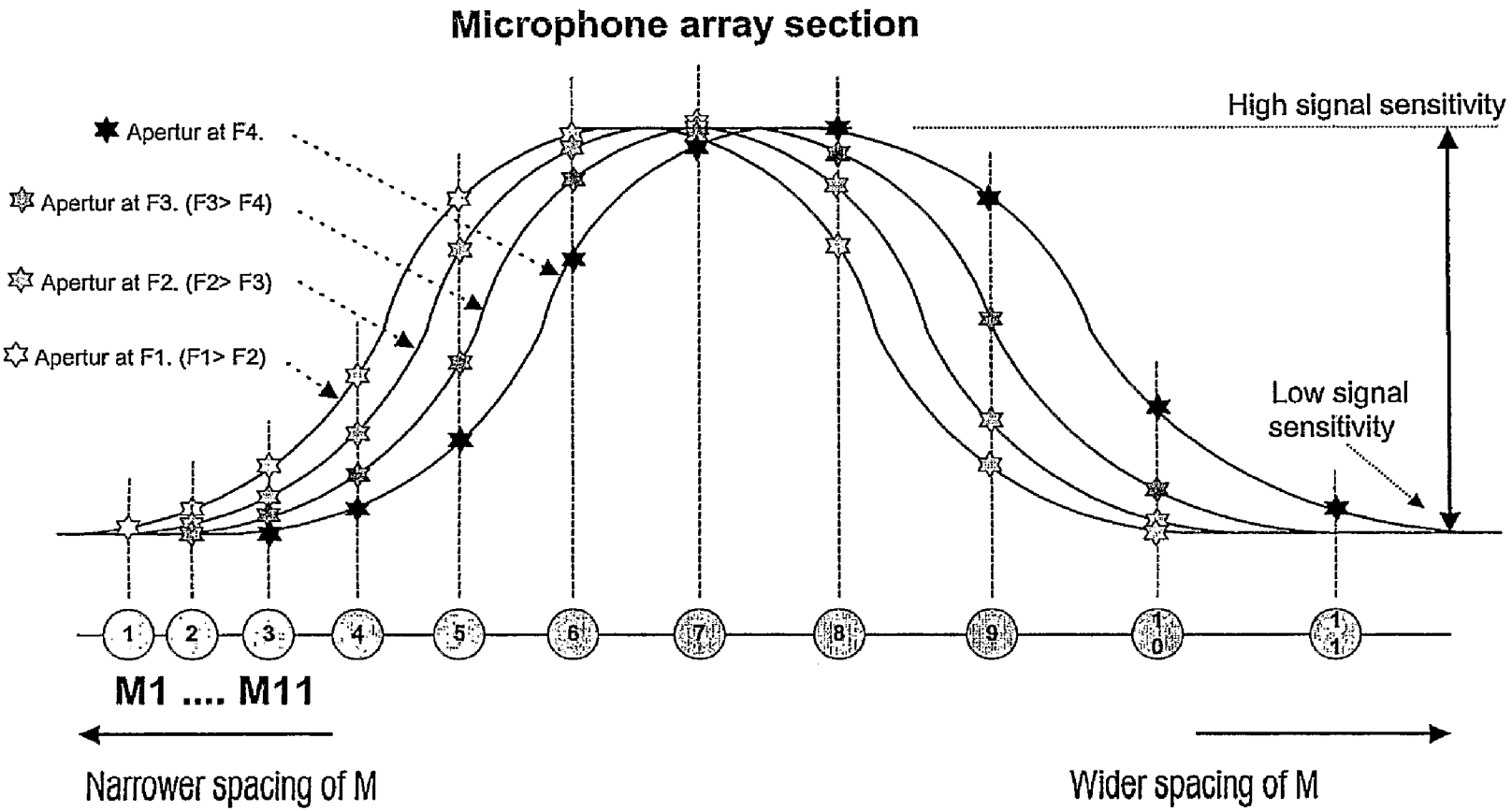
FIG. 5 shows the sensitivity of the microphone array with respect to three frequencies spaced close to each other.

In FIG. 5, four frequencies F1-F4 are plotted, said frequencies being spaced comparatively closely in the frequency band. If these four frequencies are applied to the microphone array of FIG. 4, the sensitivity shown in FIG. 5 to said four frequencies is obtained. As is apparent, the sensitivities of the microphones of the microphone array with respect to the individual frequencies are different, and therefore, the resulting signals from the individual microphones depend on which frequency is observed. The sensitivities to the four frequencies decrease or are reduced when reaching the outer limits of the active apertures at F1-F4. This reduction in the microphone sensitivity may also be referred to as a weighting of the signals or, depending on the point of view, an apodisation of the active aperture for frequencies F1-F4.

Another important factor is the selection of band-pass filtering for the individual microphones. Although the passbands of the individual band-pass filters are positioned at different frequencies, a signal of a given frequency generates a signal from all band-pass filters, said signal being attenuated to a greater or lesser degree. For correct summation of the signals it is important that the signals are in phase, regardless of the attenuation from a given filter. This can only be achieved using digital filters with a pole position, resulting in a constant group propagation time within the entire frequency range used.

Below is an example illustrating the resulting amplification with eight microphones for two frequencies $f_1$ and $f_2$ having the same amplitude.

| | M1 | M2 | M3 | M4 | M5 | M6 | M7 | M8 | SUM |
|---|---|---|---|---|---|---|---|---|---|
| $f_1$ | 0.05 | 0.1 | 0.7 | 1.0 | 1.0 | 0.7 | 0.1 | 0.05 | 3.7 |
| $f_2$ | 0.0 | 0.02 | 0.75 | 0.95 | 1.0 | 0.8 | 0.12 | 0.07 | 3.7 |

M1-M8 are eight active microphones and SUM is the summated signal after band-pass filtering. The two frequencies are spaced comparatively closely. It is important that the amplitude of the summated signal for each frequency is the same. This is an important property of band-pass filters, as this is a contributing factor for achieving the frequency-independent directivity.

Figure 6:
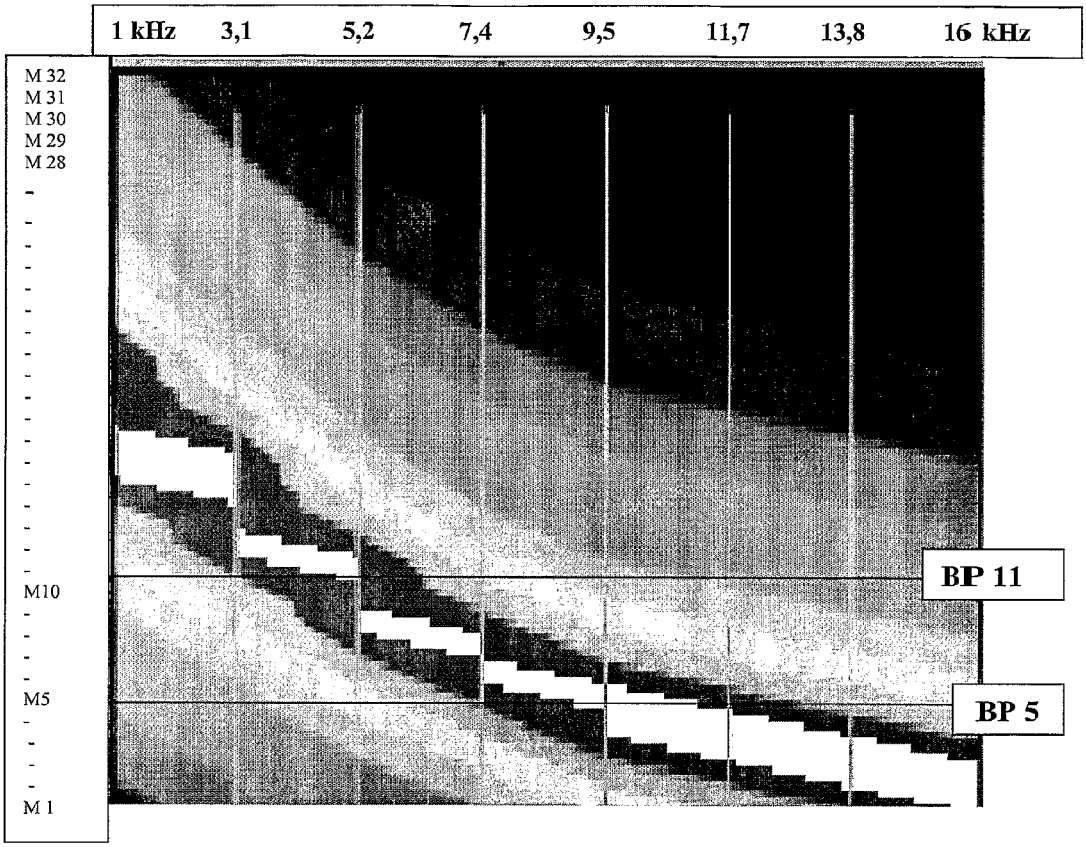
FIG. 6 shows a microphone array having 32 microphones as well as the sensitivity of said microphones as a function of the frequency.

FIG. 6 shows the sensitivities of the individual microphones in a microphone array according to the invention. The horizontal axis is the frequency range under investigation. The vertical axis is the individual microphone number. The dark, or black, colour indicates the lowest sensitivity and the light, or white, colour indicates the highest sensitivity. A horizontal line through the diagram, for example the one denoted BP11, corresponds to the band-pass filter for microphone M11, and in the same way, horizontal line BP5 corresponds to the band-pass filter for microphone M5. Therefore, the sensitivities of the microphones depend on their positions and the frequency range they are intended for. Of course, there is a great number of possible band-pass filters for the individual microphones, and it goes without saying that the resulting directivity of the microphone array depends on the selection. If all band-pass filters of FIG. 4 are altered so that they possess a narrower bandwidth with the same centre frequency, the active aperture, being a function of the frequency, becomes smaller, and a reduced number of microphones are active for any given frequency. As a result, directivity decreases. If, on the other hand, the bandwidth is increased, the active apertures become wider, and directivity is improved.

Figure 7:
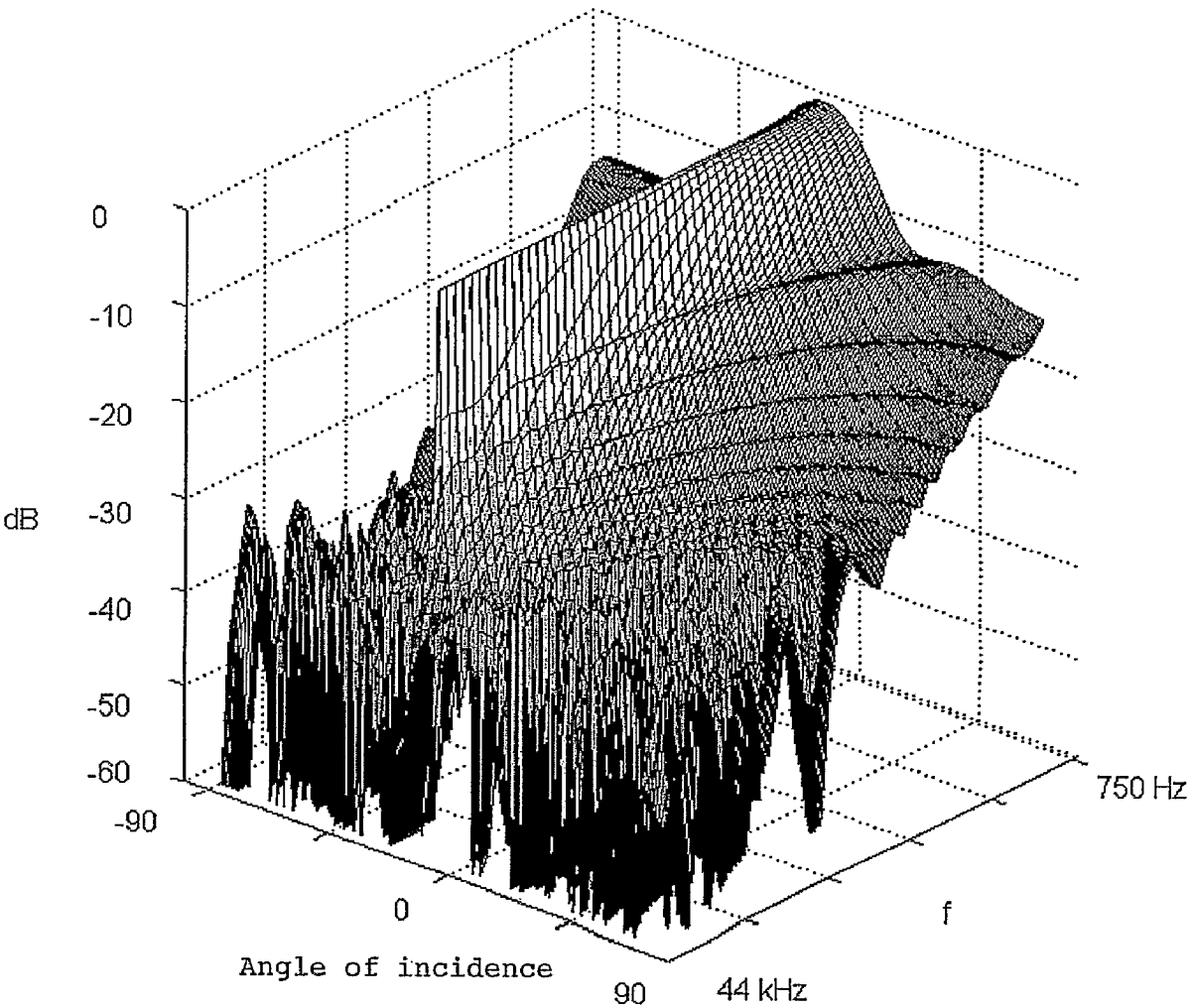
FIG. 7 shows the directivity of a microphone array without band-pass filters.

In a system comprising all parts according to the invention, i.e, both the frequency-dependent microphone positioning and the band-pass filters for the individual microphones, several interesting results are obtained. A first example is shown in FIG. 7. The illustrated example comprises a 60 cm microphone array having 40 microphones disposed with exponential spacing and intended for the frequency range 750 Hz to 44 kHz, corresponding to about 6 octaves. In this case, no band-pass filters for the individual microphones of the microphone array are used. As is apparent, sensitivity to all frequencies is high along the centre axis of the microphone array. At high frequencies, the sensitivity of the microphone array decreases considerably with the angle of incidence for the sound, and thus, the microphone array achieves high directivity for high frequencies. At the low frequencies, however, there is no substantial difference between the sensitivity of the microphone array with respect to sound incident along the centre axis of the microphone array and sound incident at an angle to said centre axis. Thus, the microphone array has poor directivity for those very low frequencies.

Figure 8:
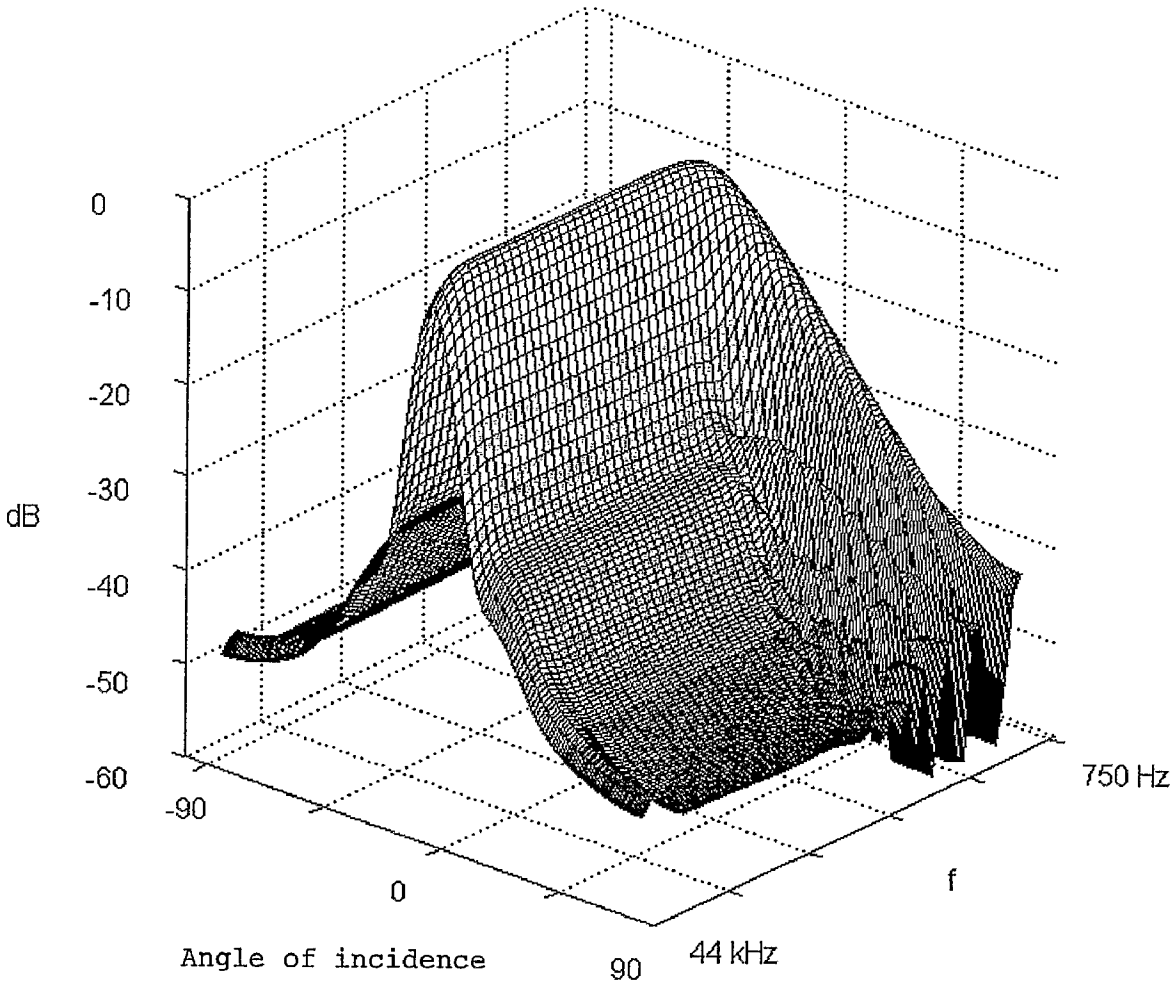
FIG. 8 shows a microphone array according to the invention with band-pass filters.

Regarding FIG. 8, a completely different result is shown. In FIG. 8, a microphone array corresponding to the one of FIG. 7 is employed, but in this case, band-pass filters are used for the individual microphones, said filters being adapted according to the frequency bands they are used for, as described above. The sensitivity of the microphone array to high frequencies is more or less identical to the sensitivity illustrated in FIG. 7, while the sensitivity of the microphone array to low frequencies is substantially different. As is apparent, the sensitivity of the microphone array to sound incident at an angle to the centre axis is substantially lower than the sensitivity of the microphone array around the centre axis, even to low frequencies. It should be noted that the effect of the band-pass filters used is also apparent in the form of an attenuation at the highest and lowest frequencies. In the end, the directivity of the microphone array according to the invention is based on a design where possible band-pass filters, physical size and desired directivity are all being taken into consideration. Thus, it is achieved that the microphone array has a high directivity in a large frequency range, said directivity at the same time being substantially constant across a large frequency range. It should be noted that the sidebands are visible in both FIG. 7 and FIG. 8, but that in FIG. 8 said sidebands are substantially attenuated.

It should be noted, of course, that the passbands and the cut-off frequencies of the individual band-pass filters may be altered regularly, thus apart from said microphone array having a high directivity in a large frequency range also allowing for the directivity of a microphone array to be altered regularly, so that the same microphone array can display different directivity characteristics, depending on the setting of said individual band-pass filters. It should also be noted that the individual signals from the individual microphones of the microphone array may be reused so that the same microphone array may display a high directivity and a very small directivity, depending on the processing of the signals, by using two or more sets of band-pass filters simultaneously. The signals from the individual microphones of the microphone array may also be recorded separately and band-pass filtered at a later time, thereby determining the desired directivity at a later stage.

The invention is explained above on the basis of an elongated microphone array. However, this is not the only embodiment that may be used. One or more microphone arrays according to the invention may, for example, be arranged mutually perpendicular or with another mutual angle, thereby allowing a more detailed directivity sensitivity.

Figure 10:
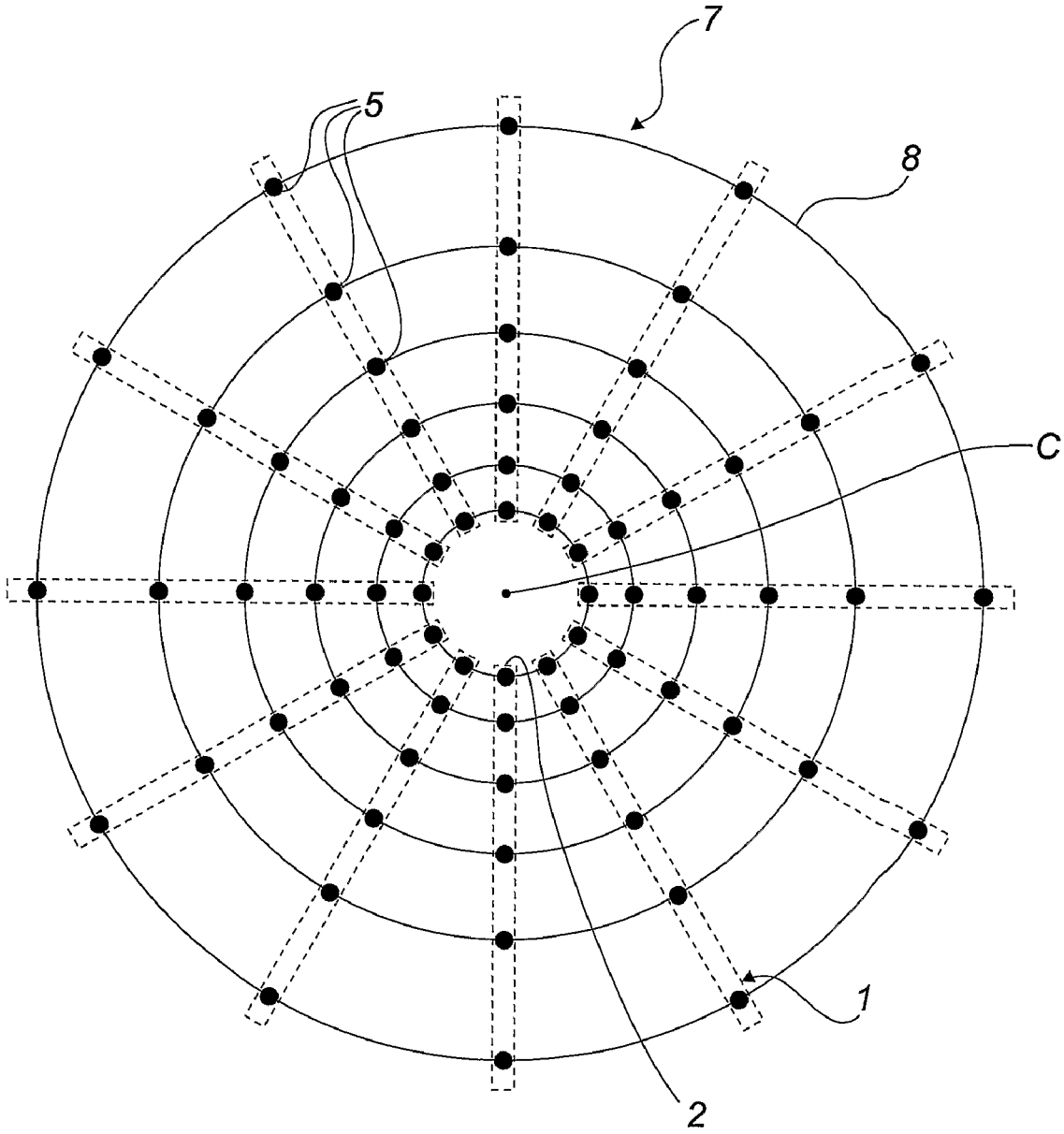
FIG. 10 shows a microphone arrangement according to the invention comprising a number of microphone arrays according to the invention.

As illustrated in FIG. 10, a microphone arrangement 7 may consist of two or more elongated microphone arrays 1. In this embodiment, the microphone arrays 1 are disposed along radii of an imagined circle, where the reference ends 2 of the microphone arrays face centre C of the imagined circle. Thus, the individual microphones 5 are arranged in concentric circles 8, the radial distance between the individual circular arcs 8 corresponding to the spacing of individual microphones 5 of elongated microphone arrays 1.

The spacing between microphones 5 on the circular arc on the innermost circle has to substantially correspond to or be smaller than the radial distance between the two circles closest to centre C. This means, that the greater the distance from the reference end 2 of the microphone arrays 1 to the centre C, the more microphone arrays 1 have to be used in the microphone arrangement 7. Therefore, it is important to keep the latter distance as small as possible or, in other words, to keep the centre opening as small as possible. Preferably, the angles between the individual microphone arrays 1 or radii are identical.

The signals from microphones 5 of the microphone apparatus 7 are all associated with time delays selected in such a way that the effect of the microphone apparatus 7 is focused in at least one direction and/or against one punctiform area in front of the microphone apparatus. Band-pass filtering of the signals takes place with the summated signals from the microphones 5 of the same circle 8 after having time delayed the signals from the microphones 5. The time delays and band-pass filters may be selected in such a way as to enable simultaneous focusing in several directions with the same directivity efficiency. The same may be accomplished by running the signals from individual microphones 5 through several sets of time delays and/or several sets of band-pass filters.

Figure 11:
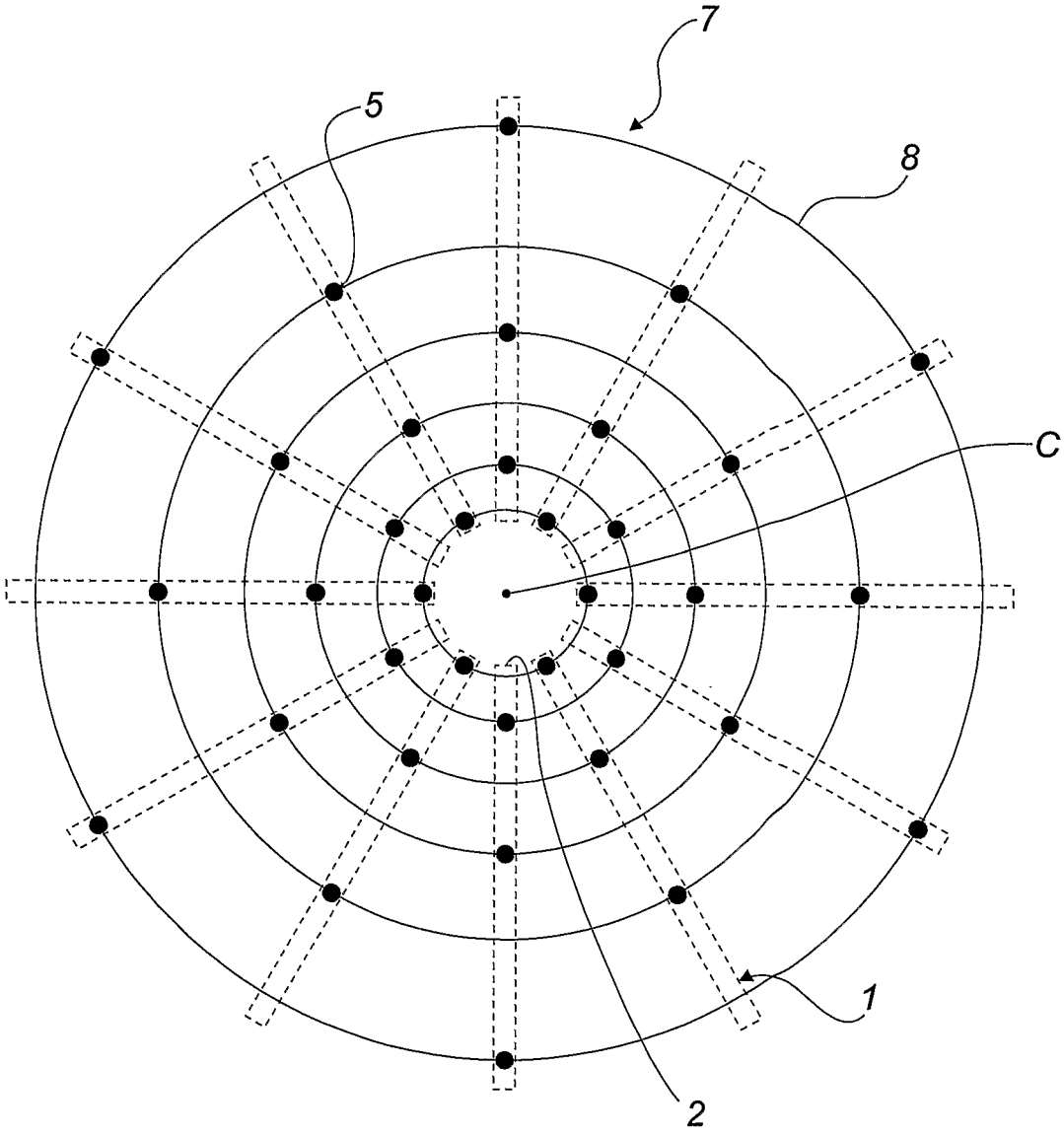
FIG. 11 shows a further microphone arrangement according to the invention.

The elongated microphone arrays 1 of the microphone arrangement do not necessarily need to be identical. For example, only every second microphone array may be identical, as illustrated in FIG. 11. Microphone arrays 1 may be assembled in such a way that the individual microphones 5 of the microphone arrays 1 are only on every second concentric circle 8. This way, a number of microphones may be dispensed with out losing the directivity and/or focusing in question. Naturally, other combinations are also possible, such as only every third or fourth microphone array 1 being identical.

Figure 9:
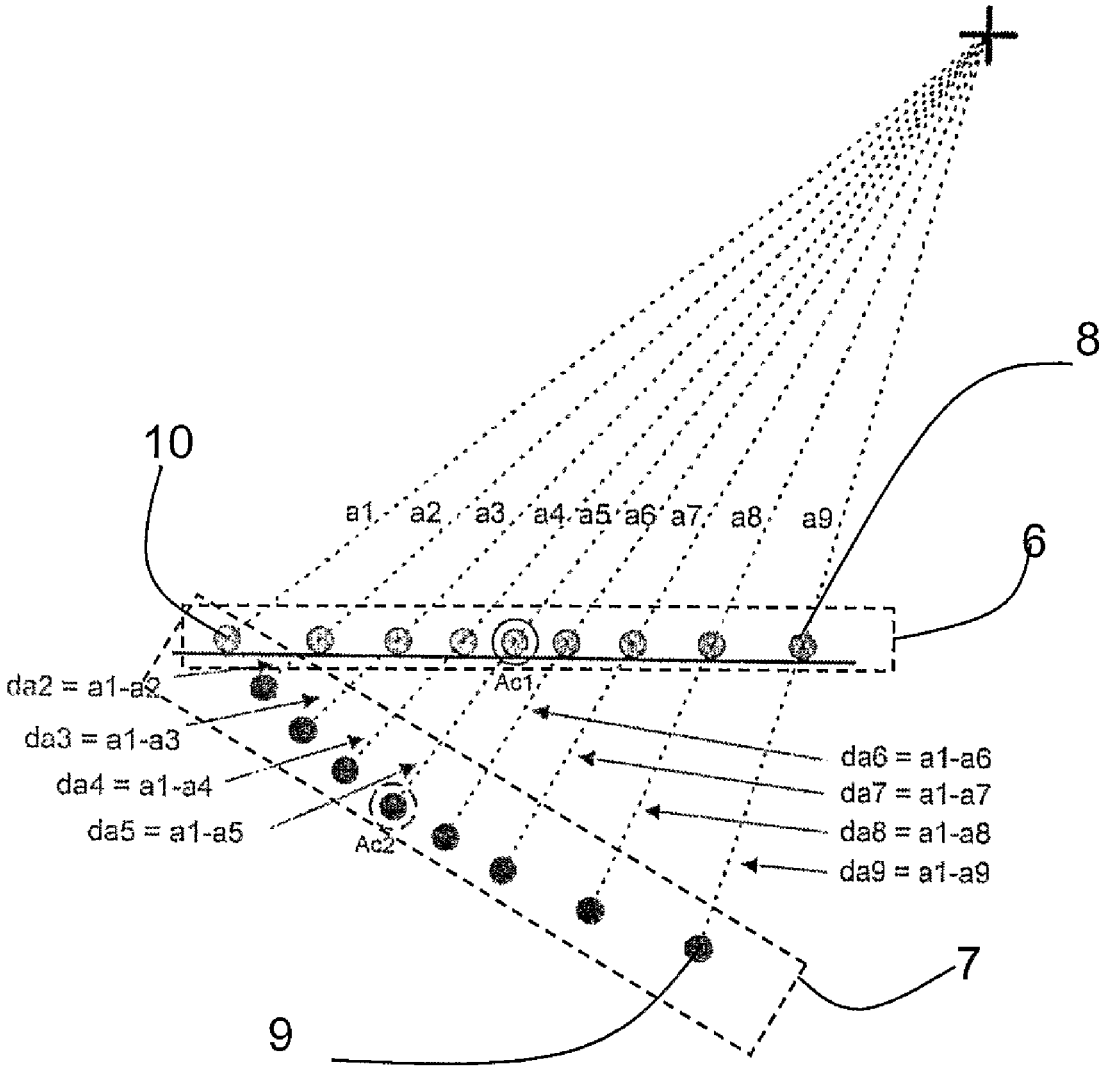
FIG. 9 shows an alternative embodiment of the microphone array according to the invention.

As shown in FIG. 9, the time delays are used to apparently rotate the flat microphone array 6 and focusing it on a point in space outside the microphone array 6. This apparent rotation is achieved by considering the actual position of the microphones and the positioning necessary to achieve the desired focusing and rotation. The time delays are determined at by means of the apparent distances the microphones have to be moved in order to achieve the rotation and focusing. The altered microphone apparatus 7 can focus on a punctiform sound emitter while achieving the same advantages as with the elongated microphone array according to the invention. The same signals from individual microphones may be used more than once, and therefore it is possible to focus on several points at the same time. It is also possible to use different band-pass filters and to obtain different directivities for the individual focal points.

Above, the invention has been described by way of several exemplary embodiments. However, it is possible to make alterations to the illustrated examples without deviating from the scope of the invention. For example, it is conceivable to dispose the individual microphones on a paraboloid or cone in a microphone arrangement, which may possibly provide several new effects, such as an attenuation of the rear side sensitivity of the microphone arrangement. It is also conceivable to position a single microphone in the centre of the microphone apparatus.

The invention claimed is:

1. Microphone array (1) for achieving a substantially frequency-independent directivity using a plurality of microphones (5) disposed along a rectilinear array, where:

the rectilinear array is at least as long as the wavelength of the lowest frequency, where a useful directivity is desired, the rectilinear array has a first end (2) and a second end, the microphones close to the first end (2) are intended for the highest frequencies and the microphones close to the second end are intended for the lowest frequencies, the position of the microphones is given by the formula:

$$l_n = l \cdot 2^{-\left(\frac{N-n}{d}\right)}$$

wherein l is longest wavelength, for which frequency-independence is desired, N is the maximum number of microphones, $l_n$ is the position of the n'th microphone with respect to the end of the microphone array, which is intended for the highest frequencies, and d is the number of microphones per octave, the signals from the individual microphones (5) are time-delayed so that phase differences or propagation time differences caused by the spatial position of the microphones (5) are taken into account, characterised in that the signals from the individual microphones (5) each independently are band-pass filtered, the band-pass filters for the individual microphones being digital with a pole position, resulting in a constant group propagation time within the entire frequency range used and ensuring that the signals from the band-pass filters are in phase, wherein the ratio between the bandwidths and centre frequencies of the individual band-pass filters is constant, and wherein the signals after band-pass filtering are summated for obtaining the output signal.

2. Microphone array according to claim 1, characterised in that signals from the individual microphones of the microphone array are recorded prior to being time-delayed and band-pass filtered, and that these signals are time-delayed and band-pass filtered at a later stage for obtaining the desired directivity.

3. Microphone arrangement, comprising at least two microphone arrays (1) according to claim 1, characterised in that the at least two microphone arrays (1) are arranged in one plane.

4. Microphone arrangement according to claim 3, characterised in that the microphone arrays (1) are disposed substantially along radii extending from the centre C of an imagined circle, the first ends (2) facing the centre C.

5. Microphone arrangement according to claim 4, characterised in that at least two different individual microphones (5) from different microphone arrays (1) are disposed along imagined concentric circles (8) having the same centre C.

6. Microphone arrangement according to claim 4, characterised in that the shortest circular arc spacing between microphones (5) on the circle closest to the centre C substantially corresponds to or is smaller than the radial distance between the two circles closest to the centre C.

7. Microphone arrangement according to claim 3, characterised in that the signals from the individual microphones (5) are each associated with time delays selected in such a way that the effect of the microphone arrangement is focused in at least one direction and/or against one punctiform area in front of the microphone apparatus.

8. Microphone arrangement according to claim 7, characterised in that the individual band-pass filterings are carried out for summated signals from the individual microphones (5) on the same circular arc (8) after the signals from the microphones (5) have been time-delayed.

9. Microphone arrangement according to claim 8, characterised in that the signals from individual microphones (5) are run through several sets of time delays and/or several sets of band-pass filters.

* * * * *